US006293334B1

(12) United States Patent
Ghiani

(10) Patent No.: US 6,293,334 B1
(45) Date of Patent: Sep. 25, 2001

(54) HEAT TRANSFER ASSEMBLY FOR A MOTOR VEHICLE AND METHOD OF ASSEMBLING SAME

(75) Inventor: Franco Ghiani, Bietigheim-Bissingen (DE)

(73) Assignee: Behr GmbH & Co., Stuttgart (DE)

( * ) Notice: Subject to any disclaimer, the term of this patent is extended or adjusted under 35 U.S.C. 154(b) by 0 days.

(21) Appl. No.: 09/038,008

(22) Filed: Mar. 11, 1998

(30) Foreign Application Priority Data

Mar. 11, 1997 (DE) ..... 197 09 909
May 27, 1997 (DE) ..... 197 22 98

(51) Int. Cl.[7] ..... F28F 9/02

(52) U.S. Cl. ..... 165/149; 165/173; 165/174; 165/175

(58) Field of Search ..... 165/149, 175, 165/173

(56) References Cited

U.S. PATENT DOCUMENTS 3,016,230 * 1/1962 Cederstrom et al. ..... 165/148
5,535,819 * 7/1996 Matsuura ..... 165/149
5,667,004 * 9/1997 Kroetsch ..... 165/41

FOREIGN PATENT DOCUMENTS 378353 7/1964 (CH) .
7229162 10/1973 (DE) .
3834822 4/1990 (DE) .
9111412 12/1991 (DE) .
19536999 4/1996 (DE) .
19543986 5/1997 (DE) .
0170952 2/1986 (EP) .
2-92492 * 7/1990 (JP) ..... 165/149

* cited by examiner

*Primary Examiner*—Allen Flanigan
(74) *Attorney, Agent, or Firm*—Evenson, McKeown, Edwards & Lenahan, P.L.L.C.

(57) ABSTRACT

An improved heat transfer assembly for a motor vehicle is provided. Typically, a heat transfer assembly has a fin/tube block consisting of flat tubes and corrugated ribs. The ends of the flat tubes are widened, and collection containers are installed at the widened tube ends. According to the invention, each collection container is kept open laterally with respect to the longitudinal axis. Side parts have end sections with opposing front ends facing the collection container. These opposing front ends close off the open side areas of the collection containers. One use of the heat transfer assembly is as a radiator in a motor vehicle.

5 Claims, 3 Drawing Sheets

HEAT TRANSFER ASSEMBLY FOR A MOTOR VEHICLE AND METHOD OF ASSEMBLING SAME

This application claims the priority of German Appln. Nos. 197 09 909.2 and 197 22 098.3, filed on Mar. 11, 1997 and May 27, 1997, respectively, the disclosures of which are expressly incorporated by reference herein.

BACKGROUND AND SUMMARY OF THE INVENTION

This invention concerns a heat transfer assembly for a motor vehicle with a fin/tube block including flat tubes and corrugated ribs. All tube ends of the flat tubes are widened to achieve a flat and flush contact. Two collection containers are installed at opposite tube ends of the fin/tube block. The collection containers grip flush over the tube ends, as well as over two side parts, which extend at least over the length of the fin/tube block. The side parts connect to opposite sides of the fin/tube block.

One heat transfer assembly is described in unpublished German application DE 19,543,986.4. This heat transfer assembly has a fin/tube block that consists of numerous flat tubes and corrugated ribs arranged between the flat tubes. The tube ends of the flat tubes are widened at the front side of the fin/tube block in a free square section. The length of the tube ends lie flush on the neighboring flat tubes so that a tube end packet is formed at front and rear sides of the fin/tube block. This tube end packet is gripped over the sides by a collection container dimensioned in such a way that it can be installed to close off the tubes and be flush with the narrow sides of the tube ends. Side parts are arranged on the sides of the fin/tube block. The side parts can be attached to the outside or inside of the closed side areas of the collection containers.

A primary object of the present invention is to provide a heat transfer assembly of the kind described above that has a simplified construction and, therefore, is easier to manufacture.

This object is attained by holding each collection container open, with respect to the longitudinal axis, at its side areas, and by having each of the side parts include end sections at its opposite ends that close off the open side areas of the collection container. The solution provided by the invention makes it possible to considerably simplify the structure of the collection containers, since they must no longer have closed side areas. Closure of the side areas is carried out by the end sections of the side parts. The invention provides for the requirements of a mechanical heat transfer assembly permitting a considerably more economical manufacture. The cost of production of the heat transfer assembly is reduced by the simpler construction of the collection container with open front areas. A functional closing off of the side areas of the collection container is obtained by attaching the side parts to the fin/tube block. Simple positioning and alignment of the individual components of the heat transfer assembly are made possible in this way. Installation of the collection container onto the fin/tube block can be carried out before installation of the side parts. Alternatively, attachment of the side parts can be carried out before installation of the collection container onto a preassembled unit including side parts and a fin/tube block.

According to one feature of certain preferred embodiments of the invention, each open side area of the collection container has an identical inner contour over at least a certain axial length with respect to the longitudinal axis of each collection container, and each end section of the side parts is provided with an end contour adapted to the inner contour of a corresponding side area so that the end sections can be inserted flush into the side areas. This feature is particularly advantageous when the collection containers, the fin/tube block and the side parts are all made of metal and the collection containers are brazed together with the fin/tube block and the side parts in a mutual brazing process. The collection containers, the side parts, and the fin/tube block are preferably solder-plated at least at their contact sites. The collection containers, the side parts, and the fin/tube block are preferably already attached by actual brazing. The side parts can be held with the aid of tightening straps or some other tightening or tensioning arrangement to the side of the fin/tube block. The end sections of the side parts already close off the side areas of the collection containers in this assembled but not yet brazed unit. By keeping the inner contours of the collection containers identical at a certain axial length, the side parts, and therefore the end sections of the side parts, can still move by a certain axial amount toward the center of the fin/tube block during the brazing process without losing the flush closure in the area of the collection containers. This is particularly advantageous since, during the brazing process, a setting movement of the fin/tube block and of the side parts takes place axis-parallel to the longitudinal axes of the collection containers to the center of the fin/tube block due to the flow of the brazing layers. Consequently, an axial following of the side parts results from a suitable tightening arrangement such as tightening straps. In this way, an extraordinarily exact and function-safe manufacture of the heat transfer assembly is obtained. Additionally, a good seal of the brazing connection is achieved despite the simplified manufacture.

According to another feature of certain preferred embodiments of the invention, the side areas of each collection container are assigned securing elements for axial support, with respect to the longitudinal axis, for the added end section of each side part. These securing elements are particularly advantageous for holding together the individual components of the heat transfer unit before effecting a firm attachment by a corresponding brazing process. The securing elements serve, therefore, to hold together the components of the collection container, the fin/tube block, and the side parts of a premounting stage and, therefore, facilitate a brazing process.

According to a further feature of certain preferred embodiments of the invention, adapted support latches are provided individually as securing elements at the side areas of each collection container, and the latches can be obtained by application of deformation forces and transferred from a narrowing release position of the inner contour of the side area into an axially gripping securing position in each end section. This is a particularly simple and functional feature that is achieved without any additional components.

According to a further feature of certain preferred embodiments of the invention, the end sections of the side parts are provided with corresponding guidance parts at the location of the securing elements so that the securing elements and the guidance parts interlock at the securing position. The securing elements and the guidance parts correspond to each other in such a manner that, in addition to an axial securing of the side parts onto the collection containers, the collection containers themselves are secured against a loss, in the longitudinal direction, of the fin/tube block, and therefore along the longitudinal direction of the flat tubes. As a result, an accurate positioning of all the components of the heat transfer with respect to each other is accomplished.

Finally, according to yet a further feature of certain preferred embodiments of the invention, the side parts include side profiles as well as end profiles rigidly connected to the side profiles, and the end profiles form the end sections and are installed at the front ends of the side profiles as an elongation of the same. In this way, it is possible to structure the side profiles as simple longitudinal profiles in a strand press process or a bending process. Consequently, the manufacturing costs of the side parts can be reduced.

BRIEF DESCRIPTION OF THE DRAWINGS

Further advantages and features of the invention will become clear from the following description of a preferred embodiment of the invention which is represented in the drawings.

DESCRIPTION OF THE PREFERRED EMBODIMENT

Figure 1:
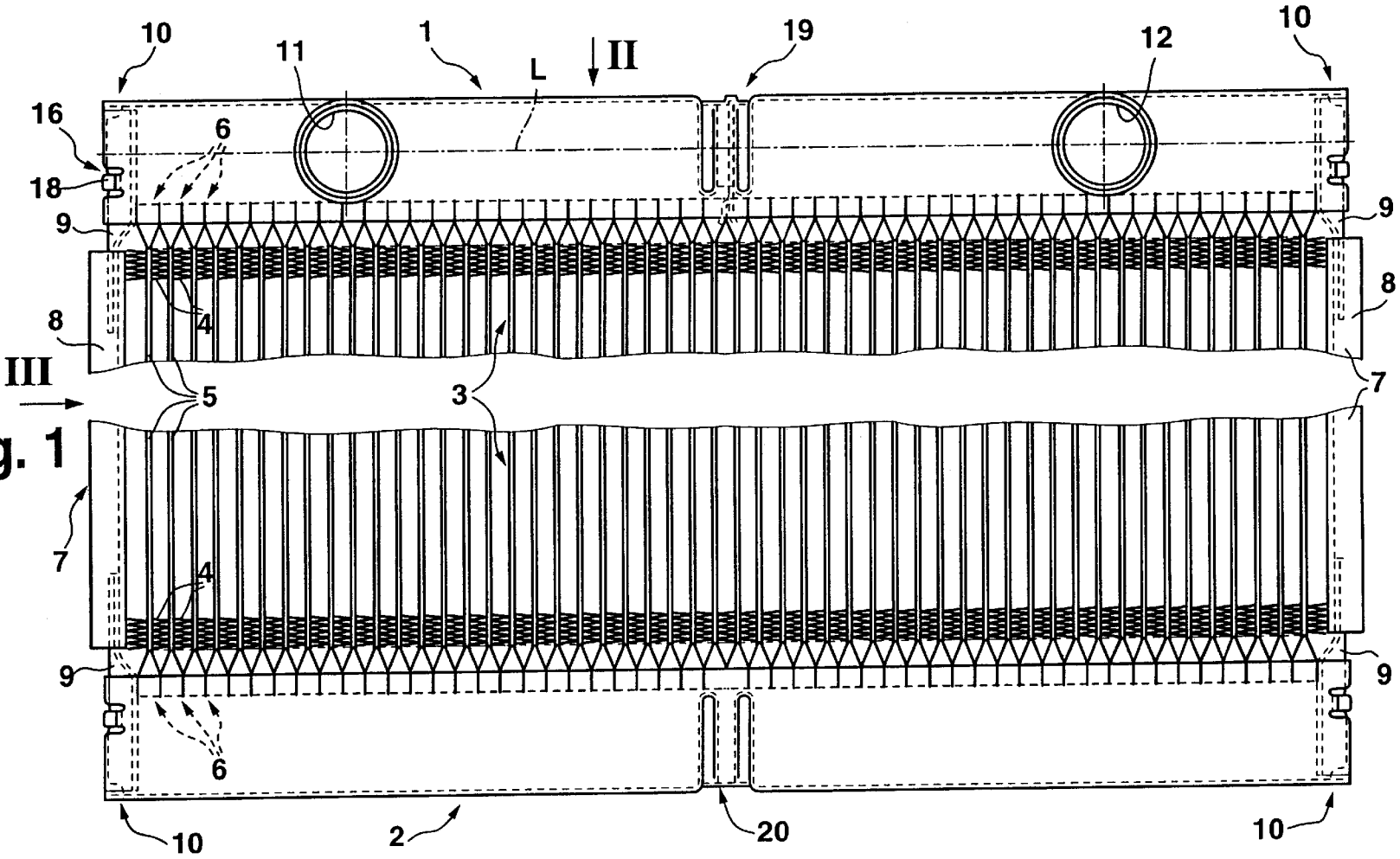
FIG. 1 is a view of a heat transfer assembly according to the invention showing its opposing collection containers.
Figure 2:
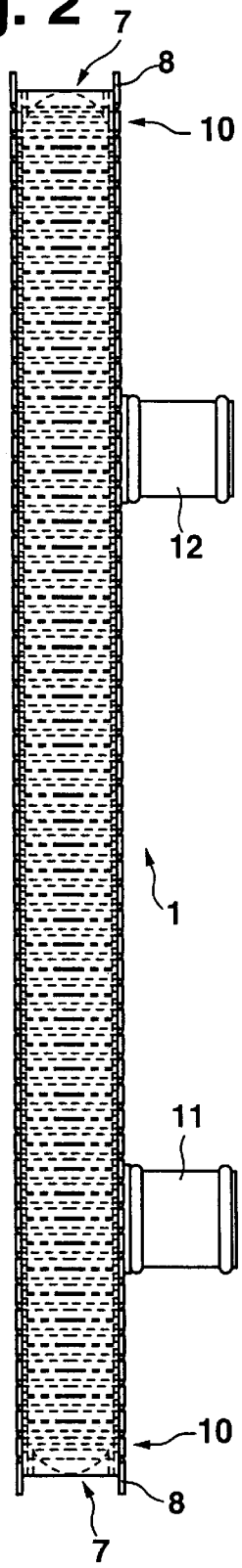
FIG. 2 is a plan view of the heat transfer assembly according to FIG. 1 as seen in the direction of arrow II of FIG. 1.
Figure 3:
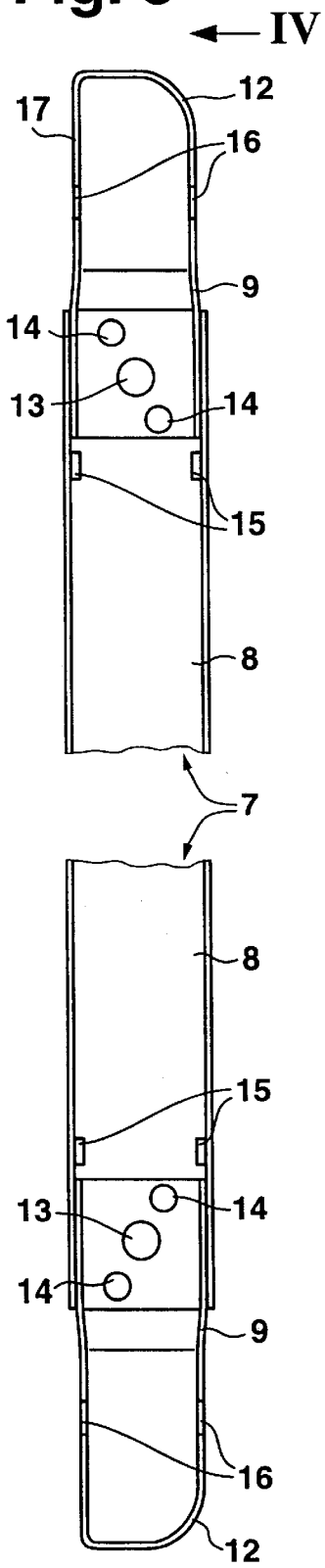
FIG. 3 is a view of a side part of the heat transfer assembly according to FIGS. 1 and 2 as seen in the direction of arrow III according to FIG. 1.
Figure 4:
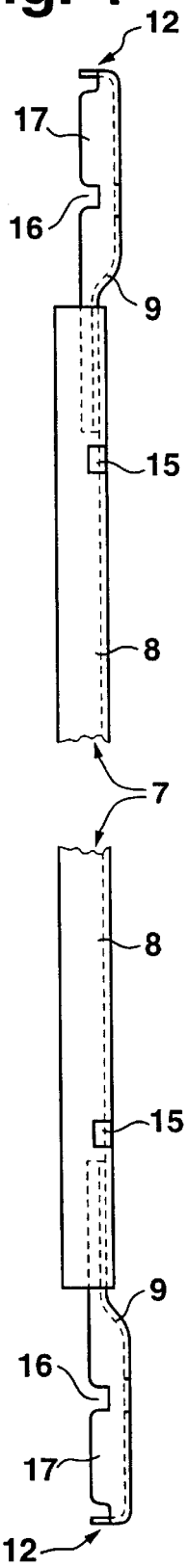
FIG. 4 is a further view of the side part according to FIG. 3 as seen in the direction of arrow IV of FIG. 3.
Figure 5:
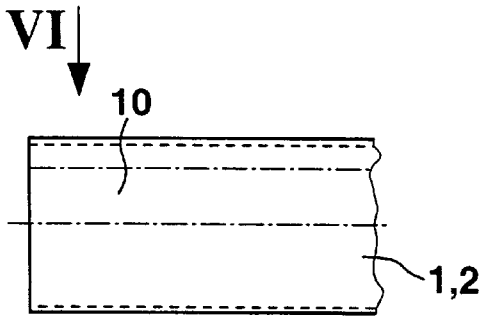
FIG. 5 is a plan view of the side area of a collection container of the heat transfer assembly according to FIG. 1.
Figure 6:
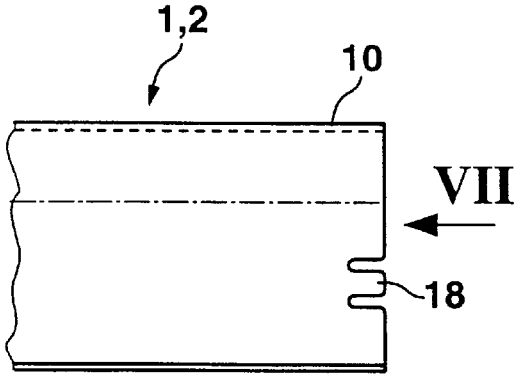
FIG. 6 is a view of the side areas as seen in the direction of arrow VI according to FIG. 5.

A heat transfer assembly according to the invention is shown in FIGS. 1 to 7 and forms a water radiator for a motor vehicle. As shown in FIG. 1, the assembly includes an upper water container 1 that serves as a collection container and a lower water container 2 also serving as collection container. Between the water containers 1, 2 extends a fin/tube block 3. The fin/tube block 3 consists of numerous flat tubes 5 that run parallel to each other, as well as corresponding corrugated ribs 4 running between the same. The water containers 1, 2 and the fin/tube block are made of solder-plated aluminum.

In the area of the water containers 1, 2, the tube ends of the flat tubes 5 are all widened in such a manner that identical free square sections result. The long sides of the neighboring tube ends lie flat against each other and the narrow sides of all tube ends 6 converge together at the opposite sides toward a front side of the fin/tube block 3. The fin/tube block 3, including the tube ends 6, is constructed according to the unpublished German patent document DE 19,543,986.4.

Figure 7:
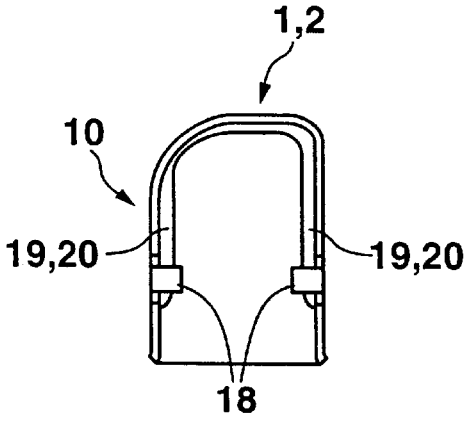
FIG. 7 is a view of the side areas as seen in the direction of arrow VII of FIG. 6 in which support latches are bent into their securing positions.

Both water containers 1, 2 are structured as simple U-shaped profiles (FIG. 7). These profiles open toward tube ends 6 of the fin/tube block 3 as well as toward their axial front sides with respect to a longitudinal axis L of each water container 1, 2. The open front sides of each water container 1, 2 form side areas 10, which are closed off by end profiles 9 of the side parts 7 that serve as end sections. The side parts 7, as well as their inclusion in the side areas 10 of the water containers 1 and 2, are described in more detail in the following.

The upper water container 1 is provided with an entry support 11 and an exit support 11' which is axially displaced from the entry support 11 with respect to the longitudinal axis L. These entry and exit supports are added hermetically to the corresponding openings of the water containers 1. A partition wall, which is described no further, is provided in the partition area 19 of the interior of the water container 1 for obtaining a separation between the entry and exit areas of the water container 1. As can be seen in FIG. 7, the partition area 19 is formed by arched rib-shaped imprints that can hold a partition wall in the interior of the water container 1. The lower water container 2 is also provided with a partition area 20, which has similar rib-like imprints, but which have no particular function in the water container 2 of the embodiment shown.

As can be seen in particular in FIG. 7, the side areas 10 of each water container 1, 2 have an even inner contour starting at their front edges and continuing up to the center of each water container 1 as seen in axial direction to the longitudinal axis L. One leg of the U-shaped profile of each side area 10 connects to the head of the profile by a greater curvature than the other leg. Each of the end profiles or sections 9 of each side part 7 has an outer contour that serves as end contour and is adapted exactly to the inner contour of the corresponding side area 10 of a respective water container 1, 2. Each end section 9 is structured as a tongue-shaped plate piece made of aluminum which is bent symmetrically to the widening of the tube ends (FIG. 1). A surrounding installation flange 17 is provided at the outer edge of each end section 9. This flange protrudes at a right angle from the end section 9 and defines end contours 12 of each end section 9 adapted to the inner contour of the side area 10 of each water container 1, 2. The installation flange 17 also makes the end section 9 rigid. As can be seen in FIG. 1, the end sections 9 of both water containers 1, 2 are positioned in such a way that they delimit the outer corrugated ribs 4 at each side of the fin/tube block 3 and lie on the tube ends 6 of the corresponding outer flat tube 5. The plate-like bottom of each end section 9 runs from each tube end 6 in parallel elongation of the flat tubes 5 at a right angle to the longitudinal axis L of each water container 1 up to the head of the side area 10 of each water container 1, 2. The installation flange 17 protrudes outwardly up to the front edge of each side area 10 and closes off the front edge of each side area 10 with its front edge. The outer side of the installation flange 17 lies flat around the inner contour of the side area 10 of each water container 1.

Each side part 7 includes a U-shaped side profile 8 as well as the end sections 9 installed as elongations of the side profile 8. The end sections 9 are inserted exactly in the opposite front side of the U-shaped side profile 8 and are connected to the side profile 8 by a stud connection 13 as well as with the aid of two brazing points 14. Two opposite-lying indentations 15 are provided in the side profiles 8 and serve, in connection with the end sections 9, for fixing attachment elements for holding the heat transfer assembly in the motor vehicle.

The water containers 1, 2 and the side parts 7 are fixed in position relative to each other, as well as in mutual positions relative to the fin/tube block 3, before brazing of the total unit. To fix the water containers and side parts in this way, two support latches 18 are punched out. These support latches narrow toward the walls of the side wall of each water container 1, 2 and, therefore, also toward the inner contour of the corresponding side area 10 at the front edges of each side area 10 at opposite sides and at the same location. At the same location, each receiving end profile or section 9 has two receiving grooves 16 adapted in their dimensions to the support latches 18. These grooves 16 are punched out at the same locations at two opposing sides of the installation flange 17. This is most clearly shown in FIG. 4.

For mounting the heat transfer assembly, the water containers 1, 2 are pushed onto the corresponding tube ends 6 in the longitudinal direction of the fin/tube block 3 and, therefore, pushed along the longitudinal directions of the flat tubes 5, and the side parts 7 are assembled from opposite sides of the assembly. In this way, the water containers are positioned on the fin/tube block. The end sections 9 of the side parts 7 are pushed axially with respect to the longitudinal axis L of each water container 1, 3 into the open side areas 10 of the water containers 1, 2 until the front edges of the installation flange 17 and the side areas 10 are flush with each other. At this time, the support latches 18 are pushed inwardly around the edges of the bottoms of corresponding receiving grooves 16 and grip behind the installation flanges 17 of corresponding end sections 9 and secure the same. The support latches 18 grip exactly in the receiving grooves 16. The support latches 18, therefore, form securing claws which stress the end sections 9 of the side parts 7 axially to the center of each water container 1, 2 with respect to the longitudinal axis L. The support latches also provide a form-fitting securing mechanism for the water containers 1, 2 in the longitudinal direction of the fin/tube block 3 and, therefore, in the longitudinal direction of the flat tubes 5. As a result, the individual components can be added without the consequent brazing to form an already compact unit. The side parts 7 are stressed at this point by using tightening straps extending across the longitudinal direction of the fin/tube block 3. The total fin/tube block 3 is stressed in this way by pressure in the traversal direction. In an additional brazing process, the brazing layers of the different brazing platings begin to flow. As a result, a setting movement of the complete unit results. This produces a pushing together or "following" of the side parts and the fin/tube block 3 in the traversal direction of the fin/tube block 3 toward the center. The inner contours of the side areas 10 and the installation or end contours 12 of the end sections 9 of the side parts 7 correspond to one another. A hermetic closure of the side areas 10 of the water containers 1, 2, therefore, is maintained by the end sections 9 during the brazing process. In this way, a simple and mechanically feasible manufacture and brazing of the heat transfer assembly is obtained.

The heat transfer assembly described can also be used with transfer media other than water and air. Air/air heat transfer media, for example, can be used. The term "water" is used here to designate water per se and water which is mixed with certain additives. Coolant fluids other than water can also be used.

The foregoing disclosure has been set forth merely to illustrate the invention and is not intended to be limiting. Since modifications of the disclosed embodiment incorporating the spirit and substance of the invention may occur to persons skilled in the art, the invention should be construed to include everything within the scope of the appended claims and equivalents thereof.

I claim:

1. A heat transfer assembly for a motor vehicle comprising:

a fin/tube block having flat tubes and corrugated fins, all tube ends of the flat tubes being widened for a flat and flush contact, two collection containers contacting the tube ends of the flat tubes and set on opposite sides of the fin/tube block at the tube ends, said collection containers gripping flush over the tube ends, and two side parts which extend over the length of the fin/tube block and contact opposite sides of the fin/tube block, wherein each collection container is structured with open side areas with respect to its longitudinal axis, and the side parts have respective end sections which close off the side areas of the collection containers, wherein each open side area has at least one inner contour that extends over a certain axial length of each collection container, and each end section is provided with an end contour which is adapted to one inner contour of a corresponding side area so that the end sections can be inserted flush into the side areas, wherein the collection containers can be hermetically brazed with the tube ends of the fin/tube block and the end sections of the side parts, wherein the end contour of each end section is made from an installation flange which extends axially with respect to a longitudinal axis of one of the collection containers and closes off flat against the inner contour of the corresponding side area, and wherein the end sections of the side parts are provided with securing elements with corresponding guidance parts, and the securing elements and the guidance parts grip each other in a security position.

2. The heat transfer assembly according to claim 1, wherein each inner contour is an identical inner contour.

3. The heat transfer assembly according to claim 1, wherein the securing elements are formed as support latches provided individually at the side areas of each collection container and can be guided by a deformation force from release positions narrowing toward inner contours of the side areas into an axially gripping securing position at the end sections.

4. The heat transfer assembly according to claim 3, wherein the installation flange of each of the end sections is provided with a receiving groove serving as a guidance part, the receiving groove being adapted to grip one of the support latches and having a measurement corresponding to that of one of the support latches.

5. The heat transfer assembly according to claim 1, wherein the side parts are rigidly formed together with the connected end sections and said end sections are installed for elongating front ends of the side parts.

* * * * *